US005417567A

United States Patent [19]

Peter

[11] Patent Number: 5,417,567

[45] Date of Patent: May 23, 1995

[54] HOLDER MEANS FOR THE PARTIAL THERMAL TREATMENT OF WORKPIECES

[75] Inventor: Wolfgang Peter, Emmerich, Germany

[73] Assignee: Ipsen Industries International Gesellschaft mit beschränkter Haftung, Kleve, Germany

[21] Appl. No.: 161,927

[22] Filed: Dec. 3, 1993

[30] Foreign Application Priority Data

Jan. 30, 1993 [DE] Germany ..... 9301293 U

[51] Int. Cl.[6] ..... F27B 5/04

[52] U.S. Cl. ..... 432/205; 432/247

[58] Field of Search ..... 432/205, 253, 258, 247

[56] References Cited

U.S. PATENT DOCUMENTS

| | | | |
|---|---|---|---|
| 3,558,113 | 1/1971 | Strohmeier et al. . | |
| 3,993,433 | 11/1976 | Isaksson et al. | 432/247 |
| 4,325,694 | 4/1982 | Bergman | 432/205 |
| 4,512,737 | 4/1985 | Pierce | 432/205 |
| 5,052,923 | 10/1991 | Peter et al. | 432/205 |
| 5,193,998 | 3/1993 | Hack et al. | 432/205 |

FOREIGN PATENT DOCUMENTS

| | | |
|---|---|---|
| 0422353 | 4/1991 | European Pat. Off. . |
| 1471430 | 4/1977 | United Kingdom . |
| 2095383 | 9/1982 | United Kingdom . |

*Primary Examiner*—Henry C. Yuen

*Attorney, Agent, or Firm*—Robert W. Becker & Associates

[57] ABSTRACT

A holder means for the partial thermal treatment in an oven, especially a vacuum chamber oven that provides compressed gas quenching, of tools or workpieces, especially drill bits, that have a working portion and a portion that is to be clamped. The workpieces, which are guided by a base plate that is provided with holes, rest upright upon a bottom plate. The base plate is provided with a radiation shield on that side that faces the oven chamber. The upper surface of the radiation shield has a high emission factor for thermal radiation, and the radiation shield is disposed directly on the base plate.

20 Claims, 1 Drawing Sheet

HOLDER MEANS FOR THE PARTIAL THERMAL TREATMENT OF WORKPIECES

BACKGROUND OF THE INVENTION

The present invention relates to a holder means for the partial thermal treatment in an oven, especially a vacuum chamber oven that provides compressed gas quenching, of workpieces, especially drill bits, that have a working portion and a portion that is to be clamped.

U.S. Pat. No. 5,052,923, Peter et al, discloses a receiving means for tools that are to be subjected to a thermal treatment, with the receiving means being provided with a radiation shield on that side that faces the oven chamber. With this heretofore known holder means, a base plate is provided and has holes for receiving the tools; that side of the base plate that faces the oven chamber is provided with an insulating plate that is intended to prevent thermal conduction to the base plate. As an additional layer, a radiation shield is disposed upon the insulating plate and has a low thermal emission value, i.e., it reflects thermal radiation. Although this known receiving means makes it possible to insulate the base plate from the thermal radiation in the oven chamber, unfortunately the tools have a large transition zone between the hardened working portion and the non-hardened portion that is to be clamped, with this being brought about due to the fact that an insulating plate that is to provide an adequate insulating effect must be very thick. In addition, with the known receiving means the working portion of the tool that is to be hardened exhibits a varying hardness gradient because as a consequence of the radiation shield, which has a high thermal reflection value, the thermal radiation from the surface of the radiation shield is reflected onto the tools and thereby causes the tools to be heated in an irregular manner.

It is therefore an object of the present invention to provide a holder means for the partial thermal treatment of tools or other workpieces in ovens, with such a holder means making it possible to have as small a transition zone on the workpiece as possible and while maintaining a good thermal insulation adequately guiding the workpieces in the base plate.

BRIEF DESCRIPTION OF THE DRAWINGS

This object, and other objects and advantages of the present invention, will appear more clearly from the following specification in conjunction with the accompanying schematic drawing, in which.

SUMMARY OF THE INVENTION

Figure 1:
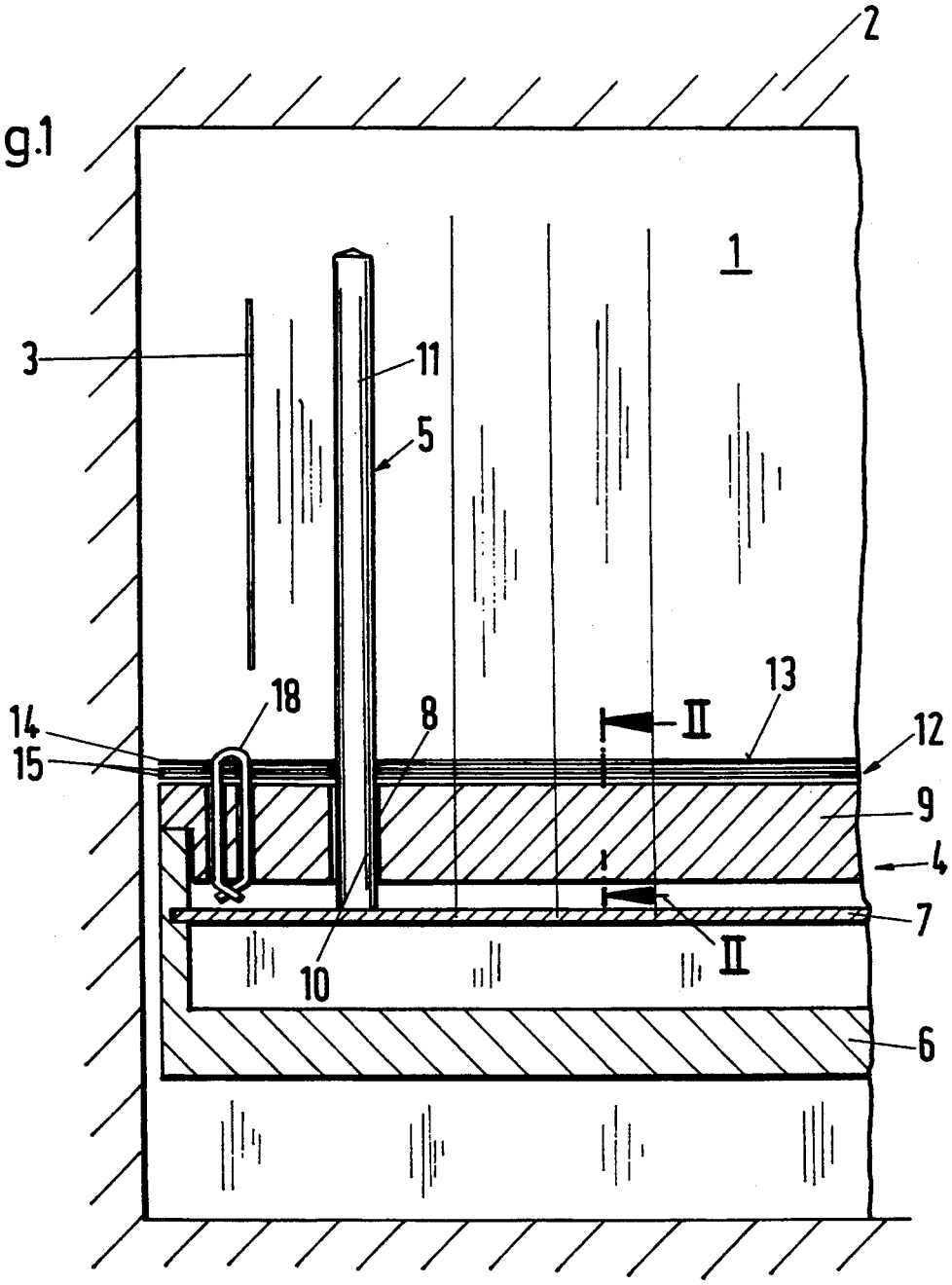
FIG. 1 is a cross-sectional view through a portion of an oven chamber that is provided with one exemplary embodiment of the inventive holder means.

The holder means of the present invention comprises a base, a bottom plate that is disposed in the base, a base plate that is supported by the base and is provided with holes for guiding workpieces such that they can rest in an upright manner on the bottom plate, and a radiation shield that is disposed directly on a side of the base plate that faces the oven chamber, with a surface of the radiation shield that faces the oven chamber having a high emission factor for thermal radiation.

With the inventive holder means for the partial thermal treatment of tools and workpieces, a very short transition zone between the hardened and non-hardened portions of the workpiece is achieved. Due to the high thermal emission factor of the upper surface of the radiation shield, the greatest portion of the thermal radiation is first absorbed and is subsequently again emitted to the heating chamber, as a result of which a homogenous distribution of the temperature in the heating chamber is achieved. The high emission factor, i.e. low reflection factor, for thermal radiation furthermore prevents an irregular heating of the workpieces as occurs when there is merely a reflection of the thermal radiation. By disposing the radiation shield directly on the base plate, in other words without the interposition of an insulating plate, the transition zone in the workpiece can be kept very small.

Pursuant to one preferred specific embodiment of the inventive holder means, the radiation shield has a multi-layer construction, including an uppermost layer that faces the oven chamber and has as high an emission factor for thermal radiation as possible, and lower layers that have as low an emission factor for thermal radiation as possible. With such a multi-layer construction of the radiation shield, the lower layers that have a low thermal emission factor reflect the thermal radiation that is encountered so that due to the differing emission or reflection factors of the individual layers of the radiation shield, a maximum insulation of the base plate relative to the oven chamber is obtained.

To ensure an adequate emission of the thermal radiation, that surface of the radiation shield that faces the oven chamber has a thermal emission factor of from 0.8 to 1.0, preferably 0.9. Materials that have proven to be satisfactory for that surface of the radiation shield that faces the oven chamber include, for example, polished metal surfaces, graphite, and carbon fiber reinforced graphite (CFC). The layer thickness of the surface of the radiation shield is, for example, between 0.5 and 2.5 mm. By providing such a small layer thickness for the surface of the radiation shield, the amount of energy to be absorbed is limited. The minimal thickness is limited by the mechanical properties of the materials, since these materials must be able to withstand the mechanical forces encountered during the gas flow in the cooling phase. In addition to the use of polished metal surfaces, graphite and CFC have in particular proven to be satisfactory due to their high durability. Furthermore, graphite and CFC are characterized by low abrasion, thus avoiding contamination of the interior of the oven with particles that have broken or worn off.

The thermal emission factors of the lower layers of the multi-layer radiation shield are preferably between 0.03 and 0.3. To achieve a transition zone on the workpiece that is as short as possible, thin metal sheets or foils having a layer thickness of from 0.03 to 0.5 mm are utilized for the lower layers of the radiation shield. Since the lower layers are made of very thin sheets or foils, it is even more important that the uppermost layer have a high resistance to the gas flow, since this layer at the same time serves as a protective layer for the thin lower layers.

To reduce the thermal conductivity between the individual layers of the radiation shield, and hence between the radiation shield and the base plate, insulating gaps or layers can be disposed between the individual layers. Whereas the insulating layers can be made, for example, of ceramic material, the insulating gaps are merely spaces between the layers, and can be formed, for example, by placing wavy or corrugated layers upon one another.

The material of the individual layers of the radiation shield should be such that this material has a saturated steam or vapor pressure that is less than the operating pressure of the oven, since vapor depositions on the surfaces of the layers could have a significant adverse effect upon the emission or reflection characteristics thereof.

In order with a multi-layer radiation shield to achieve a maximum shielding of the base plate from the thermal radiation, the individual layers could be made of different materials. By utilizing a different material for each layer, it is possible to precisely employ the emission or reflection characteristics of different materials at a respectively desired location. Materials that have been demonstrated to be suitable include nickel and nickel alloys, such as chromium nickel alloys and copper nickel alloys (Monel), since these alloys have a low saturated vapor pressure and a low thermal emission factor.

Pursuant to one preferred specific embodiment of the inventive holder means, the radiation shield comprises one upper layer and three lower layers. Such a configuration with three lower layers has proven to be adequate if the emission and reflection factors of the materials are well coordinated with one another. Such a material combination results, for example, by using layers of nickel, copper and aluminum. With such a combination, the base plate is nearly completely shielded from the thermal radiation by the three-layer lower layer, with the workpieces receiving only a short transition zone since the radiation shield comprises not only very few but also very thin layers.

In order when using a radiation shield having a surface of graphite or CFC to prevent a carburization due to contact between a metal workpiece and the surface of the radiation shield, the diameter of the holes of the radiation shield for receiving the workpieces is greater than the diameter of the holes of the base plate.

To secure the radiation shield to the base plate, it is proposed to use a material that does not carburize when it comes into contact with graphite or CFC. Suitable materials for these securing elements are, for example, molybdenum and tantalum.

Finally, it is proposed that the height of the bottom plate that is disposed below the base plate be adjustable so that for workpieces having different lengths, the transition zone between the hardened working portion and the non-hardened portion that is to be clamped can be adjusted at the desired location.

Further specific features of the present invention will be described in detail subsequently.

DESCRIPTION OF PREFERRED EMBODIMENTS

Referring now to the drawing in detail, FIG. 1 shows an oven chamber 1 of a vacuum chamber oven, with the chamber 1 being provided on the outside with an insulating means 2, and being heated in the interior thereof via heating elements 3. Disposed in the oven chamber 1 is a holder means 4 for receiving workpieces 5 that are to be subjected to a partial thermal treatment in the oven chamber 1.

The holder means 4 for receiving the workpieces 5 comprises a base 6, a bottom plate 7, and a base plate 9 that is provided with holes 8. The workpieces 5 are placed in the holder means 4 such that, guided by the holes 8 of the base plate 9, they are disposed upright with a portion 10 that is to be clamped and that is not to be hardened resting upon the bottom plate 7, while the working portion 11 that is to be hardened projects into the heatable oven chamber 1.

In order to be able to insulate the base plate 9 from the oven chamber 1, the base plate 9, on that side that faces the oven chamber 1, is provided with a radiation shield 12, the upper surface 13 of which is such that it first absorbs the thermal radiation that is at hand and subsequently again emits the same toward the oven chamber 1, thereby enabling a homogeneous distribution of the temperature in the oven chamber 1.

Figure 2:
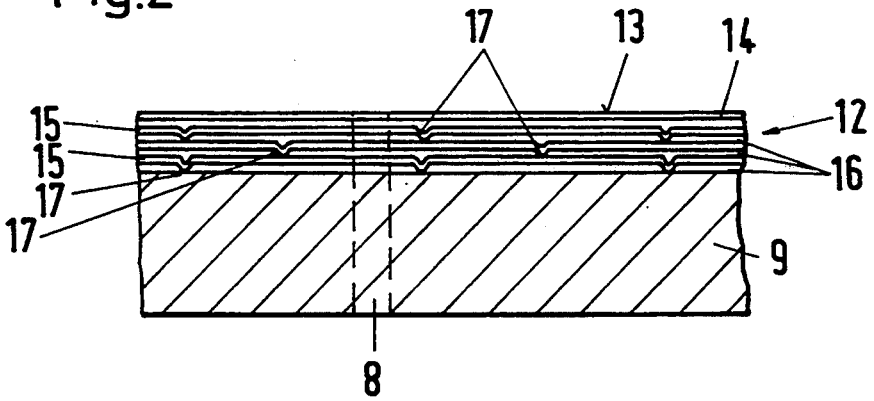
FIG. 2 is an enlarged cross-sectional view through the inventive holder means taken along the line II—II in FIG. 1.

FIG. 2 shows an enlarged cross-sectional area through the base plate 9 and the radiation shield 12 disposed thereon. In the illustrated embodiment, the radiation shield 12 has a multi-layer configuration. Below the layer 14, which is provided with the surface 13 that has a great thermal emission factor, are disposed three further layers 15, each of which has a very low thermal emission factor. The individual layers 15 are separated from one another by insulating gaps 16, which are produced by a wavy or corrugated form of the layers 15. In such a case, the individual layers 15 rest upon one another only at individual points of contact 17, so that no thermal conduction takes place between the individual layers 15.

In order to ensure a permanent hold between the radiation shield 12 and the base plate 9, even during the high mechanical stress that occurs during the gas quenching, securing elements 18 are provided for connecting the radiation shield 12 to the base plate 9.

During operation of the vacuum chamber oven, the heating elements 3 heat the oven chamber 1 to an operating temperature of about 1200° C. In order in the workpiece 5 to obtain as short a transition zone as possible between the working portion 11 that is to be hardened and the portion 10 that is to be clamped and that is not to be hardened, it is important that the base plate 9 of the holder means 4, which base plate guides the workpiece 5, not be heated too greatly, so that the portion 10 that is to be clamped and that is guided by the base plate 9 not be heated to the transformation temperature. To insulate the base plate 9 relative to the thermal radiation in the oven chamber 1, that side of the base plate 9 that faces the oven chamber is provided with the radiation shield 12. This radiation shield prevents excessive heating of the base plate 9 and hence of that portion 10 of the workpiece 5 that is to be clamped and that is guided in the base plate 9. By constructing the radiation shield 12 from layers 14, 15 that consist of one or more thin sheets or foils, it is possible for the transition zone in the workpiece 5 to be very small. In order to be able to adjust the exact position of the transition zone between the working portion 11 and the portion 10 that is to be clamped for workpieces 5 that have varying lengths, means are provided so that the height of the bottom plate 7 in the base 6 of the holder means 4 can be varied. For example, several slots can be provided in the base 6 for the bottom plate 7, an adjustable bracket, such as a slide bracket, can be provided, or any other suitable means for varying the height of the bottom plate 7 in the base 6 can be provided.

The present invention is, of course, in no way restricted to the specific disclosure of the specification and drawing, but also encompasses any modifications within the scope of the appended claims.

What I claim is:

1. A holder means for the partial thermal treatment in an oven chamber of an oven, of workpieces that have a working portion and a portion that is to be clamped, said holder means comprising:

a base;

a bottom plate disposed in said base;

a base plate supported by said base and provided with holes for guiding said workpieces such that they can rest in an upright manner on said bottom plate; and a radiation shield disposed directly on a side of said base plate that faces said oven chamber, with a surface of said radiation shield that faces said oven chamber having a high absorptive factor for thermal radiation, and wherein said radiation shield has a multi-layer construction, including an uppermost layer that is provided with said surface that faces said oven chamber, which surface has as high an absorptive factor for thermal radiation as possible, and also including lower layers that are disposed between said uppermost layer and said base plate, said lower layers having as low an absorptive factor for thermal radiation as possible.

2. A holder means according to claim 1, wherein said surface of said radiation shield that faces said oven chamber has an emission factor for thermal radiation of from 0.8 to 1.0, preferably 0.9.

3. A holder means according to claim 1, wherein said uppermost layer of said radiation shield, which uppermost layer faces said oven chamber, comprises polished metal, graphite, or carbon fiber reinforced graphite.

4. A holder means according to claim 1, wherein said uppermost layer of said radiation shield, which uppermost layer faces said oven chamber, has a thickness of from 0.5 to 2.5 mm.

5. A holder means according to claim 1, wherein said lower layers of said multi-layer radiation shield have an emission factor for thermal radiation of from 0.03 to 0.3.

6. A holder means according to claim 1, wherein said lower layers of said multi-layer radiation shield are thin metal sheets or foils.

7. A holder means according to claim 6, wherein said lower layers of said multi-layer radiation shield have a thickness of from 0.03 to 0.5 mm.

8. A holder means according to claim 1, wherein insulating gaps or insulating layers are disposed between the lower layers of said multi-layer radiation shield.

9. A holder means according to claim 8, wherein said insulating layers are made of ceramic material.

10. A holder means according to claim 8, wherein said lower layers rest upon one another only at discrete points of contact, thereby forming said insulating gaps between said lower layers.

11. A holder means according to claim 1, wherein said lower layers of said multi-layer radiation shield are made of different materials.

12. A holder means according to claim 1, wherein said material of said lower layers of said multi-layer radiation shield have a saturated vapor pressure that is less than an operating pressure of said oven.

13. A holder means according to claim 1, wherein said lower layers of said multi-layer radiation shield are made of nickel or nickel alloys.

14. A holder means according to claim 13, wherein said nickel alloys of said lower layers are chromium nickel alloys or copper nickel alloys.

15. A holder means according to claim 1, wherein said radiation shield comprises one upper layer and three lower layers.

16. A holder means according to claim 15, wherein said lower layers are made of nickel, copper and aluminum.

17. A holder means according to claim 1, wherein said radiation shield is also provided with holes for receiving said workpieces, with said holes in said radiation shield having a diameter that is greater than the diameter of said holes in said base plate.

18. A holder means according to claim 1, which includes at least one securing element for connecting said radiation shield to said base plate.

19. A holder means according to claim 18, wherein said securing element is made of molybdenum or tantalum.

20. A holder means according to claim 1, which includes means for adjusting the position of said bottom plate in said base.

* * * * *